US009810177B2

(12) United States Patent
Barnes et al.

(10) Patent No.: US 9,810,177 B2
(45) **Date of Patent: *Nov. 7, 2017**

(54) INTERNAL COMBUSTION ENGINE

(71) Applicant: CUMMINS IP, INC., Columbus, IN (US)

(72) Inventors: David M. Barnes, Columbus, IN (US); Jason W. Mackey, Columbus, IN (US); Adam C. Cecil, Columbus, IN (US)

(73) Assignee: Cummins IP, Inc., Columbus, IN (US)

( * ) Notice: Subject to any disclaimer, the term of this patent is extended or adjusted under 35 U.S.C. 154(b) by 66 days.

This patent is subject to a terminal disclaimer.

(21) Appl. No.: 14/760,069

(22) PCT Filed: Mar. 12, 2014

(86) PCT No.: PCT/US2014/024228

§ 371 (c)(1),
(2) Date: Jul. 9, 2015

(87) PCT Pub. No.: WO2014/165045

PCT Pub. Date: Oct. 9, 2014

(65) Prior Publication Data

US 2015/0369169 A1 Dec. 24, 2015

Related U.S. Application Data

(60) Provisional application No. 61/780,563, filed on Mar. 13, 2013.

(51) Int. Cl.
*F01M 9/10* (2006.01)
*F02F 7/00* (2006.01)
(Continued)

(52) U.S. Cl.
CPC ..... *F02F 7/0095* (2013.01); *F01L 1/053* (2013.01); *F01L 1/344* (2013.01); *F01L 1/46* (2013.01);
(Continued)

(58) Field of Classification Search
CPC ..... F02F 21/24; F02F 7/0002; F02F 7/0095; F02F 1/40; F02F 7/006; F02F 2007/0041; F02F 2007/0063; F01L 1/053
(Continued)

(56) References Cited

U.S. PATENT DOCUMENTS 3,046,952 A 7/1962 Dolza
4,915,066 A 4/1990 Koshimoto et al.
(Continued)

FOREIGN PATENT DOCUMENTS

CN 2555407 6/2003
CN 2580121 10/2003
(Continued)

OTHER PUBLICATIONS

The Search Report and Written Opinion of the International Searching Authority issued in PCT/US2014/024228, dated Jul. 9, 2014.
(Continued)

*Primary Examiner* — Ching Chang
(74) *Attorney, Agent, or Firm* — Foley & Lardner LLP

(57) ABSTRACT

An internal combustion engine and related components and methods of manufacturing and implementing an internal combustion engine and related components. The internal combustion engine includes a base, a cylinder block mounted onto the base, a cylinder head mounted onto the block, and a structural overhead member mounted onto the cylinder head, such that the cylinder head is positioned between the cylinder block and the structural overhead member. At least one through-bolt positioned in a through-bolt opening, the through-bolt opening extending from the base to the structural overhead member through the cylinder block and the cylinder head to couple the base, the cylinder block, the cylinder head and the structural overhead member together.

26 Claims, 9 Drawing Sheets

(51) Int. Cl.

| | |
|---|---|
| ***F02F 1/38*** | (2006.01) |
| ***F02F 1/40*** | (2006.01) |
| ***F01L 1/053*** | (2006.01) |
| ***F01L 1/344*** | (2006.01) |
| ***F01L 1/46*** | (2006.01) |
| ***F02F 1/24*** | (2006.01) |

(52) U.S. Cl.
CPC ..... *F02F 1/24* (2013.01); *F02F 1/38* (2013.01); *F02F 1/40* (2013.01); *F02F 7/0002* (2013.01); *F02F 7/006* (2013.01); *F02F 2007/0041* (2013.01); *F02F 2007/0063* (2013.01)

(58) Field of Classification Search
USPC ..... 123/90.34, 90.38
See application file for complete search history.

(56) References Cited

U.S. PATENT DOCUMENTS

| | | | | |
|---|---|---|---|---|
| 5,033,422 A * | 7/1991 | Kurisu | ..... | F01L 1/053 123/193.5 |
| 5,123,385 A | 6/1992 | Sado et al. | | |
| 5,522,354 A | 6/1996 | Sakamoto et al. | | |

FOREIGN PATENT DOCUMENTS

| | | | | |
|---|---|---|---|---|
| CN | 1457389 | 11/2003 | | |
| GB | EP 0525967 A1 * | 2/1993 | ..... | F02F 7/0007 |

OTHER PUBLICATIONS

First Office Action Issued for Chinese Patent Application No. 201480007883.7, dated Apr. 28, 2017, 12 pages.

* cited by examiner

INTERNAL COMBUSTION ENGINE

CROSS REFERENCE TO RELATED APPLICATIONS

The present application is a National Stage of PCT Patent Application No. PCT/US2014/024228, filed on Mar. 12, 2014, which claims priority to U.S. Provisional Patent Application No. 61/780,563, filed Mar. 13, 2013 and entitled "INTERNAL COMBUSTION ENGINE," the contents of is are incorporated herein by reference in their entirety.

BACKGROUND

Modern internal combustion engines are designed to achieve the objectives of low weight, low cost, and high efficiency. Often, these objectives compete with each other such that meeting one objective can result in the failure to meet another objective. For example, modern engine designers aim to achieve a high efficiency engine by increasing the peak cylinder pressure (PCP) capability on the engine. However, in view of the high forces generated by the high PCP that are placed on the components of the engine, stronger materials and/or greater mass of materials are required. In most cases, stronger materials also are heavier. Therefore, it is difficult for modern engines to be highly efficient, while also being lightweight. Additionally, lightweight materials, such as aluminum, tend to have relatively poor fatigue strength, which further limits its viability in high PCP engines.

In view of the above constraints, some engines utilize through-bolt schemes that maintain a block in compression. However, conventional through-bolt schemes are not conducive to accommodating other engine components vying for space as such through-bolts occupy a significant amount of space and/or require repositioning of existing components. For example, the positioning of conventional through-bolts significantly affects the space available for features associated with the lubrication system, such as the main rifle and main journal feed drillings. Additionally, if a structural overhead member, such as a cam carrier is used, the structural features of the cam carrier supporting the cam shafts of the engine should not be deflected by the tension of the through-bolts.

SUMMARY

Various embodiments provide an internal combustion engine and related components and methods of manufacturing and implementing an internal combustion engine and related components. The internal combustion engine includes a base comprising a base material, a cylinder block mounted onto the base, a cylinder head mounted onto the block, and a structural overhead member mounted onto the cylinder head, such that the cylinder head is positioned between the cylinder block and the structural overhead member. The cylinder block comprises a cylinder block material. At least one through-bolt positioned in a through-bolt opening, the through-bolt opening extending from the base to the structural overhead member through the cylinder block and the cylinder head to couple the base, the cylinder block, the cylinder head and the structural overhead member together.

Other various embodiments provide a cam carrier of an internal combustion engine. The cam carrier is mounted onto a head of the internal combustion engine. The cam carrier includes a cam shaft support portion supporting a cam shaft, a base portion configured to receive a through-bolt, and a neck portion positioned between and coupling the cam shaft support portion and the base portion. The neck portion is positioned between and couples the cam shaft support portion and the base portion such that a gap is defined below the cam shaft between the cam shaft support portion and the base.

In particular embodiments, a cam carrier of an internal combustion engine is provided that is mounted onto a cylinder head of the internal combustion engine. The cam carrier includes a valve train support portion made from a first material. The valve train support portion is mounted directly to the cylinder head. The cam carrier also includes a bolt securing portion made from a second material. The bolt securing portion is configured to receive a through-bolt and mounted directly to the cylinder head independently of the valve train support portion. The valve train support surrounds the bolt securing portion.

Other various embodiments provide a cam carrier of an internal combustion engine that includes a sidewall enclosing a space, a valve train support system positioned within the space, and a valve train lubrication system positioned within the space. The valve train support system includes a phaser, an intake cam shaft, an exhaust cam shaft, a plurality of intake bucket tappets, and a plurality of exhaust bucket tappets. Each of the bucket tappets includes an inner portion movable relative to an outer portion. The valve train lubrication system includes first intake and exhaust lubrication rifles, second intake and exhaust lubrication rifles, a plurality of feed lines fluidly coupling the first intake lubrication rifle and the intake cam shaft, a plurality of feed lines fluidly coupling the first exhaust lubrication rifle and the exhaust cam shaft, a plurality of feed lines fluidly coupling the first intake lubrication rifle and the plurality of intake bucket tappets, a plurality of feed lines fluidly coupling the first exhaust lubrication rifle and the exhaust bucket tappets, a plurality of lubrication control valves controlling the flow of lubrication between the first intake and exhaust lubrication rifles and the second intake and exhaust lubrication rifles, a plurality of feed lines fluidly coupling the second intake lubrication rifle and the intake bucket tappets, and a plurality of feed lines fluidly coupling the second exhaust lubrication rifle and the plurality of exhaust bucket tappets.

BRIEF DESCRIPTION OF THE DRAWINGS

In the drawings, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings.

The subject matter of the present application has been developed in response to the present state of the art, and in particular, in response to the problems and needs in the internal combustion engine art that have not yet been fully solved by currently available systems. More specifically, in some embodiments, the engine system of the present disclosure includes an internal engine that utilizes a multiple-component stacked configuration to achieve a high peak cylinder pressure capable engine with a relatively low weight and at a relatively low cost. Additionally, in some embodiments, the engine system includes a high-strength structural overhead member (e.g., cam carrier) specifically configured to accommodate the attachment of a through-bolt without pulling on the structure supporting the cam shafts. Further, in certain embodiments, the engine system includes a cam carrier with a high-strength portion to which the through-bolts are attached and a lightweight portion in which the cam valve train and lubrication systems are formed. Also, in some embodiments, an engine system includes a lightweight structural overhead member in a multiple-component stacked configuration that accommodates multiple cam shaft components and systems into a single package.

Figure 1:
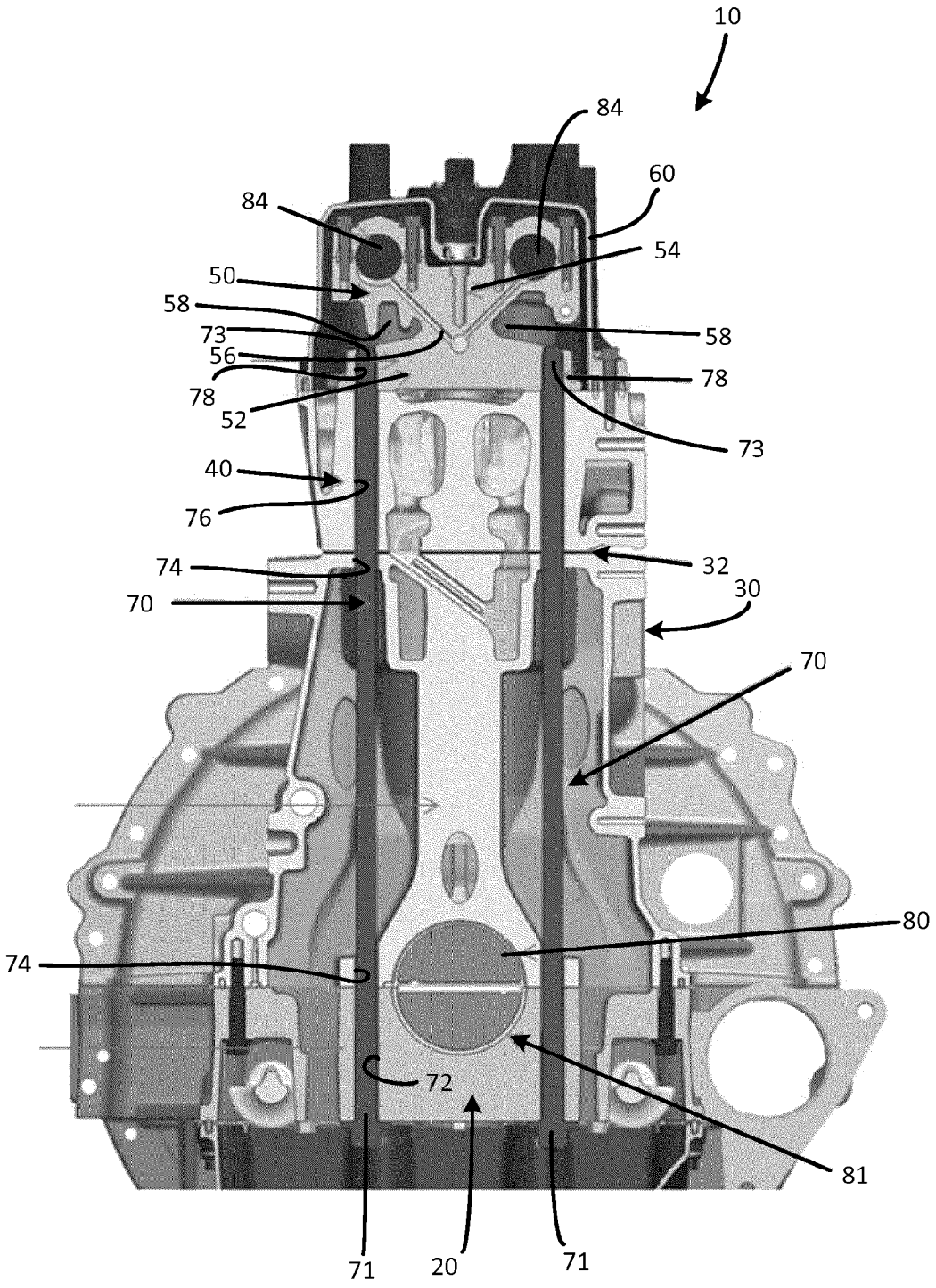
FIG. 1 illustrates a cross sectional view of an internal combustion engine according to one embodiment of the present disclosure.

Referring to FIG. 1, one embodiment of an internal combustion engine 10 includes a stacked arrangement of components. For example, as shown, the engine 10 includes a base 20, block 30, cylinder head 40, structural overhead member (e.g., cam carrier 50), and cover 60. The block 30 is mounted directly onto the base 20, which can be defined as a bed plate or ladder frame. The cylinder head 40 is mounted directly onto the block 30, and the structural overhead member or cam carrier 50 is mounted directly onto the cylinder head 40. Lastly, the cover 60 is positioned over the cam carrier 50 and secured to the cylinder head 40. In some implementations, a relatively thin sealing gasket may be positioned between one or more of the base 20, block 30, cylinder head 40, cam carrier 50, and cover 60 (see, e.g., sealing gasket 32 positioned between the block 30 and the cylinder head 40). As defined herein, in view of the relative thinness of the gasket, one component is still considered directly mounted onto another component with a gasket positioned therebetween.

The base 20 and cam carrier 50 are made from a higher-strength, heavier (higher specific weight), material, such as iron or steel, using any of various manufacturing techniques, such as machining and casting. In contrast, the block 30 and cylinder head 40 are made from a lower-strength and lighter (e.g., lower specific weight), such as aluminum, using any of various manufacturing techniques, such as machining and casting. In this manner, the components made from light-weight materials are effectively sandwiched between the components made from high-strength materials. Additionally, composite construction methods could be deployed on either high strength component enabling high cylinder pressure load management in conjunction with lighter overall weight. For instance, the base has two functions to provide crankshaft support and enclose the crankcase. The crankshaft support function could be accomplished with a high strength material and the crankcase enclosure could be constructed of a lower weight material. The base 20, block 30, cylinder head 40, and cam carrier 50 are secured together by a plurality of through-bolts 70 extending through respective apertures 72, 74, 76, 78 of the base, block, cylinder head, and cam carrier. In the illustrated embodiment, the head 71 of the bolt 70 is positioned against the base 20 and the opposing end 73 of the shank of the bolt is engaged in the aperture 78 of the cam carrier 50 (which can include internal threads that engage external threads of the bolt). Alternatively, the head of the bolt 70 can be positioned against the cam carrier 50 and the opposing end of the shank of the bolt can be engaged in the aperture 72 of the base 20. In either configuration, tightening of the bolt 70 tightens the base 20 and cam carrier 50 against the block 30 and cylinder head 40. In this manner, the block 30 and cylinder head 40 are maintained in compression throughout the entire operational range of the engine 10. Additionally, each through-bolt 70 is positioned to extend through a hollow interior of a respective bulkhead formed in the block 30. Each bulkhead of the engine 10 can be defined as the partition formed in the block 30 that divides or separates the combustion cylinders of the engine.

Figure 2:
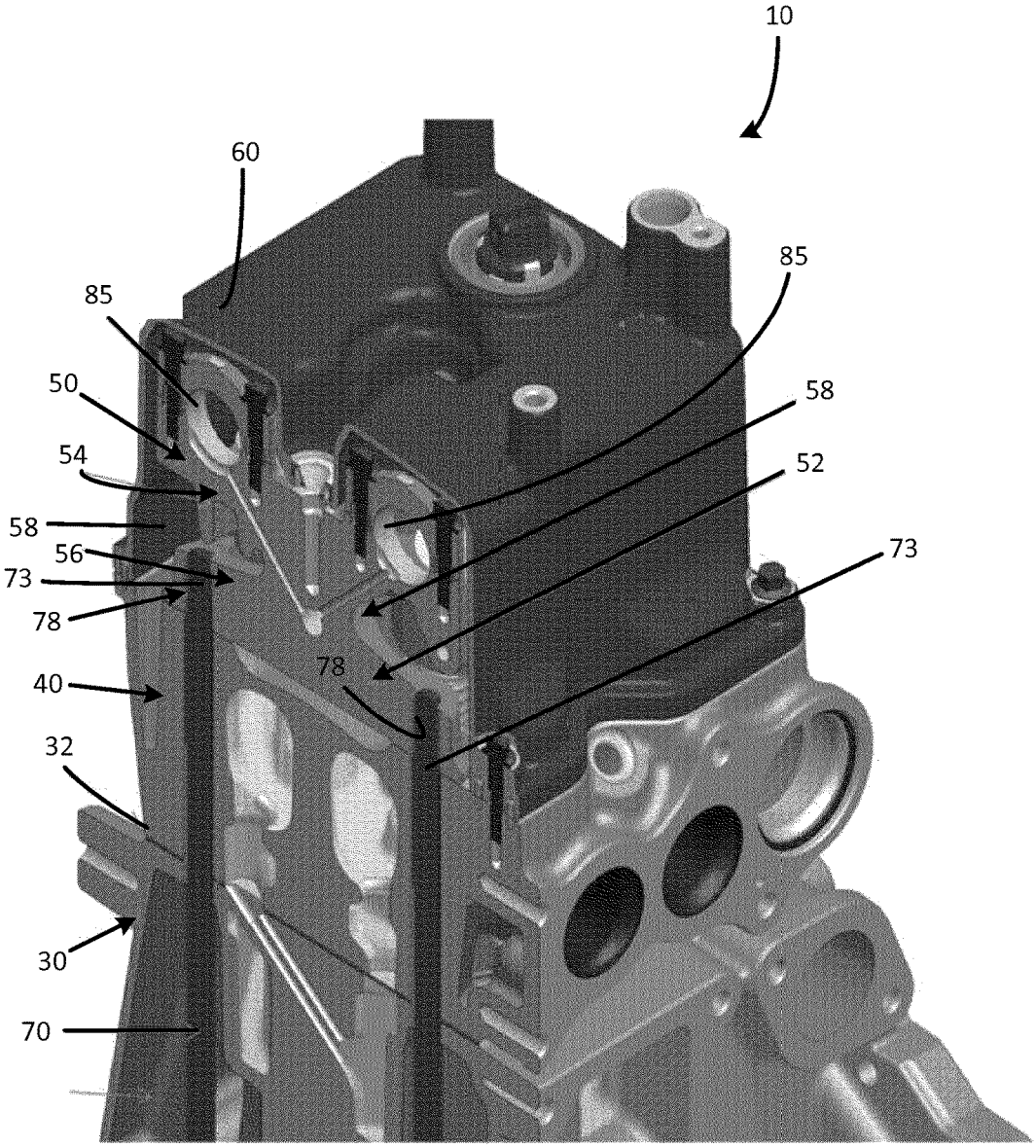
FIG. 2 is a cross-sectional perspective view of the internal combustion engine of FIG. 1.

As shown in FIGS. 1 and 2, the cam carrier 50 receives and retains intake and exhaust cam shafts or cam journals 84 within apertures 85 faulting part of a support structure 54. In the illustrated embodiment, the cam carrier 50 has a one piece-monolithic construction, and is made from iron or steel using a casting technique. For proper operation (e.g., to maintain alignment between the cam shafts 84 and the corresponding support structure 54 of the cam carrier 50), the cam shaft support structure 54 of the cam carrier cannot be pulled or squeezed. However, the cam shafts 84 are positioned nearly directly above the bolts 70, and tightening of the base 20 and cam carrier 50 against the block 30 and cylinder head 40 using the through-bolts 70 acts to pull or deflect the cam carrier 50 toward the base 20. To decouple the pulling effect on the cam carrier 50 by the through-bolts 70 from the cam shaft support structure 54, the cam carrier includes a base portion 52 and a narrow neck portion 56 that couples the cam shaft support structure to the base portion 52. The inclusion of the narrow neck portions 56 creates a physical gap 58 between the base portion and the cam shaft support structure 54. In some implementations, as shown in FIG. 1, the cam carrier 50 has a substantially I-shaped cross-section. Despite the base portion 52, neck 54, and cam shaft support structure 54 being formed of a one-piece monolithic construction, the gap 58 allows the base portion 52 to be pulled against the cylinder head 40, or deflected, without correspondingly pulling, or deflecting, the cam shaft support structure 54.

The engine 10 includes various other features necessary for operation of the engine. For example, the engine 10 includes a crankshaft positioned between the base 20 and block 30 with a plurality of main journals 80 of the crankshaft positioned within a crankshaft bore 81 defined between opposing semi-circular shaped recesses formed in the base and block. Additionally, the engine 10 may include balance shafts with one or more journals positioned within the base 20. Further, although not shown, the engine 10 includes a plurality of pistons movable within respective combustion cylinders between the bulkheads.

Figure 3:
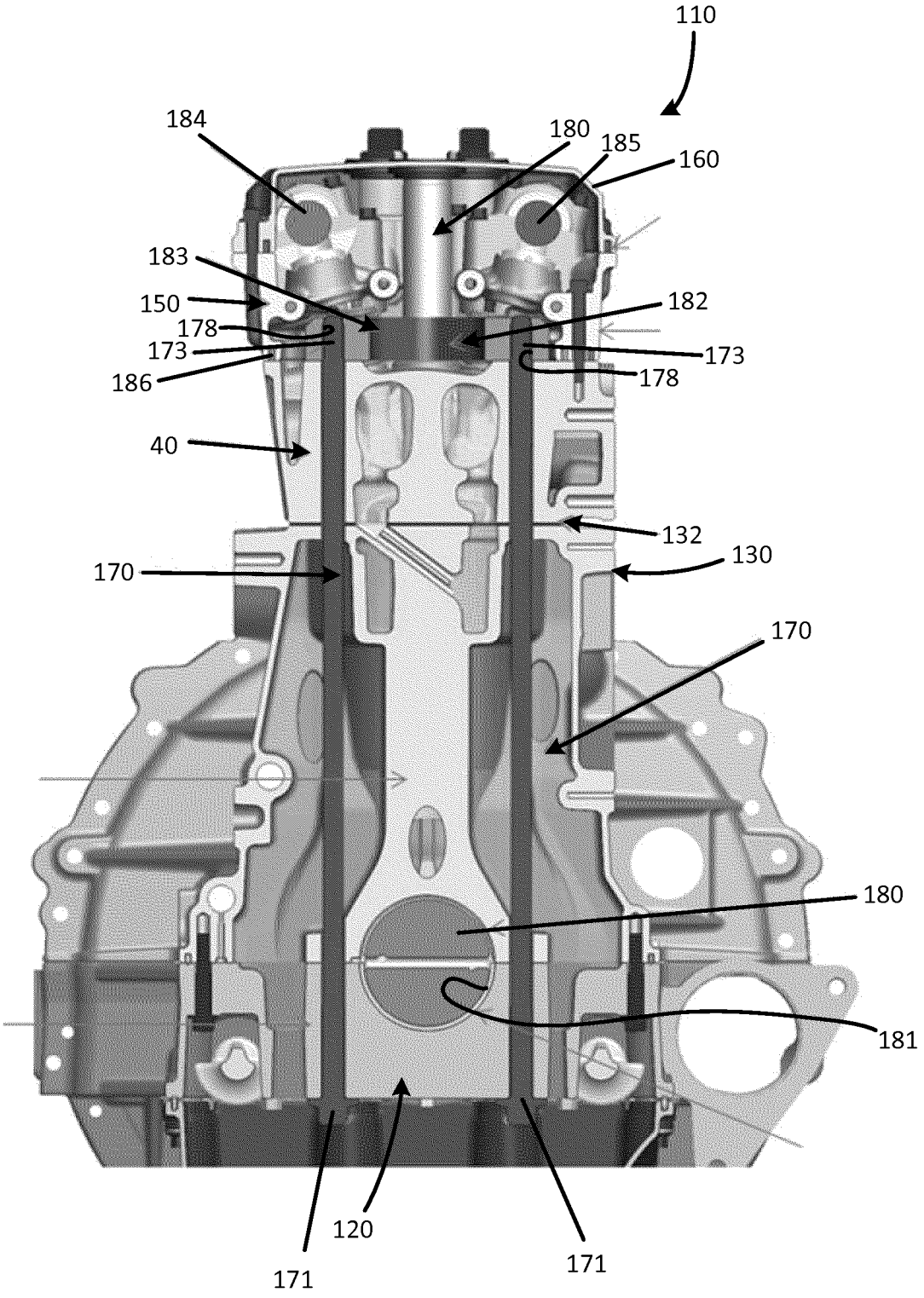
FIG. 3 illustrates a cross sectional view of an internal combustion engine according to one embodiment of the present disclosure
Figure 4:
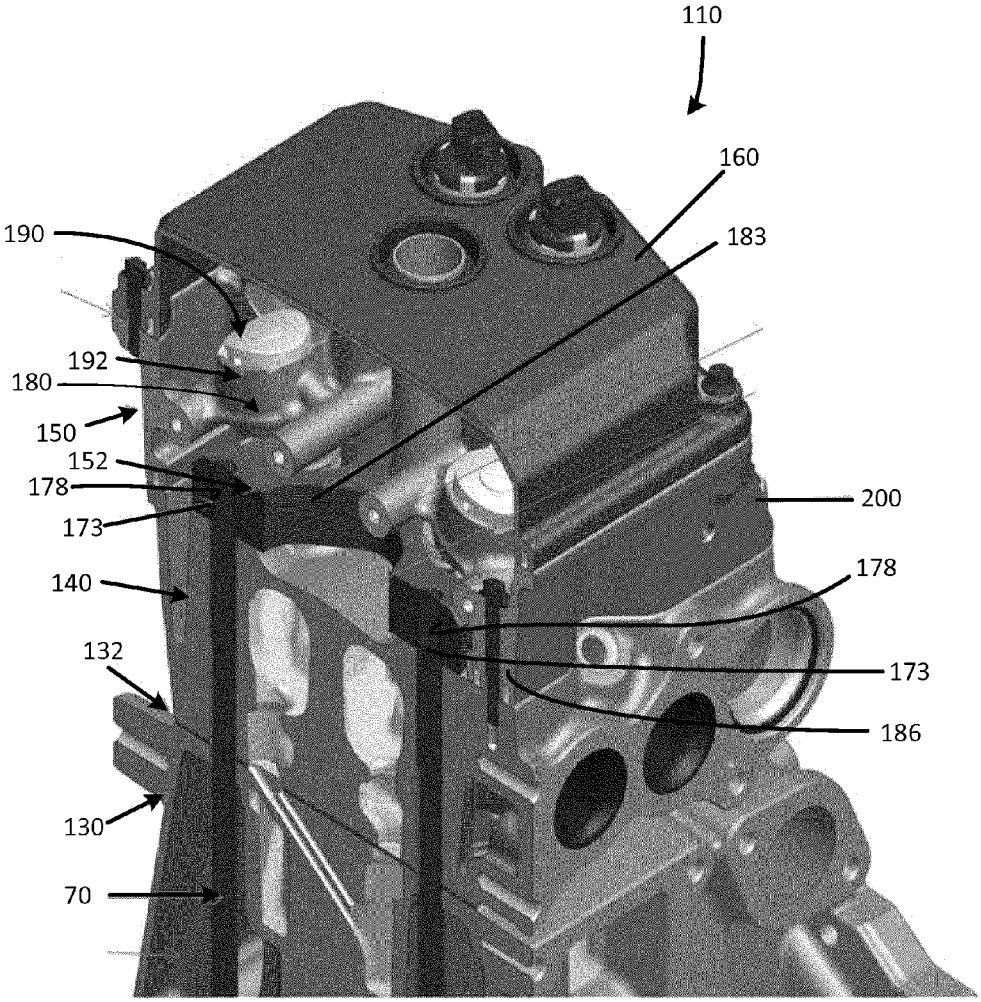
FIG. 4 is a cross-sectional perspective view of the internal combustion engine of FIG. 3.

The engine 10 shown in FIGS. 1 and 2 is particularly applicable to a diesel-powered compression-ignition engine, which requires a less complex valve train support structure 54 in the cam carrier 50 compared to gaseous-powered spark-ignition engines. Addressing the added complexity of the cam carrier and the drive for lighter-weight engines, FIGS. 3 and 4 depict a cross-section of an engine 110 powered by a gasoline, ethanol, or gaseous fuel utilizing spark-ignition techniques. The engine 110 shares features similar to the engine 10, with like numbers referring to like features. In fact, in certain implementations, the base 120, block 130, and cylinder head 140 of the engine 110 has the same configuration as the base 20, block 30, and cylinder head 40 of the engine 10. However, the cam carrier 150 is specifically configured for use as a spark-ignition engine, while the cam carrier 50 is specifically configured for use as a compression-ignition engine.

Notwithstanding the added complexity of the cam carrier 150 and the need for lighter-weight materials to accommodate the added complexity, the cam carrier must still be able to withstand the desirable high peak cylinder pressure of the engine 110. For this reason, the cam carrier 150 includes a valve train support portion 180 and a separate bolt securing portion 182. The valve train support portion 180 can be made from a lightweight material, such as aluminum, and the bolt securing portion 182 can be made from a high-strength material, such as steel or iron.

The bolt securing portion 182 is a plate-like element that includes the apertures 178 with internal threads for receiving and threadably engaging the threaded ends 173 of the bolts 170. Accordingly, the bolt securing portion 182 is secured against the cylinder head 140 to maintain the cylinder head 140 and block 130 in compression. The higher-strength material of the bolt securing portion 182 is able to withstand the high peak cylinder capability of the engine 110. The bolt securing portion 182 can include other features, such as assembly helper bolts, injector bore seals, and spark plug tubes. To uniformly distribute the head bolt load across the bolt securing portion 182, the apertures 178 are all interconnected with a plurality of ribs 183 extending between the apertures.

The valve train support portion 180 is positioned over and effectively straddles the bolt securing portion 182. The support portion 180 includes a sidewall 200 surrounding an outer periphery of the support section to laterally contain the valve train support features (e.g., cam journals, bucket tappet bores, chain tensioner mounting pad, lubrication control valve mounts, and lubrication components of the lubrication system) of the support section within the confines of the sidewall 200. The sidewall 200 includes engagement features (e.g., apertures) for facilitating direct coupling of the support portion 180 to the cylinder head 140. In this manner, the bolt securing portion 182 and valve train support portion 180 are separately or individually directly coupled to the cylinder head 140 with the support portion 180 surrounding the bolt securing portion. The cover 160 is secured to the sidewall 200 to enclose the valve train support features and bolt securing portion 182 above the cylinder head 140. The sidewall 200 also functions to raise the surface of the cam carrier 150 to which the cover 160 is secured, which reduces the service height of the engine 110.

Figure 5:
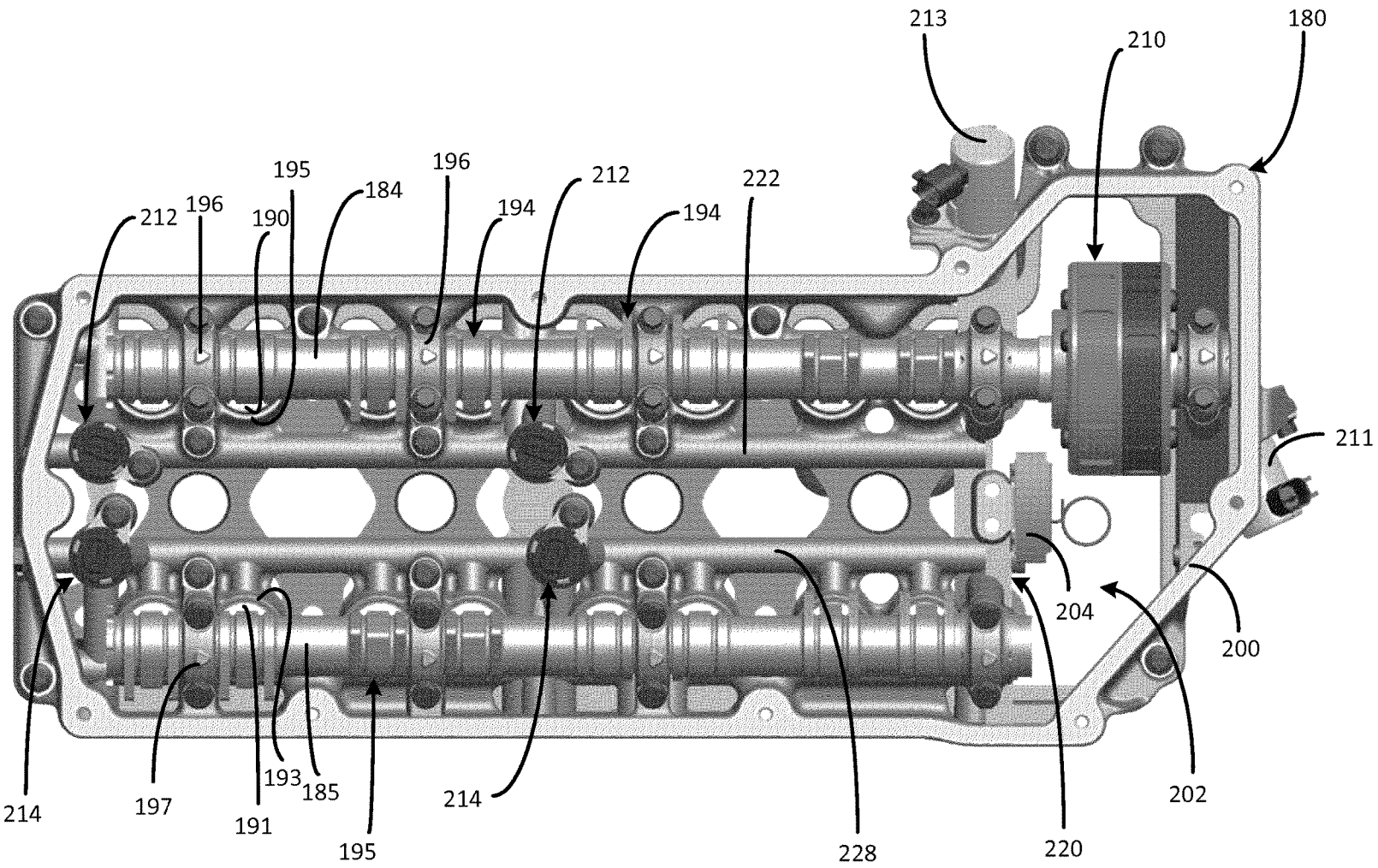
FIGS. 5-8 are top views of the valve train support portion of the of the internal combustion engine of FIG. 3.
Figure 6:
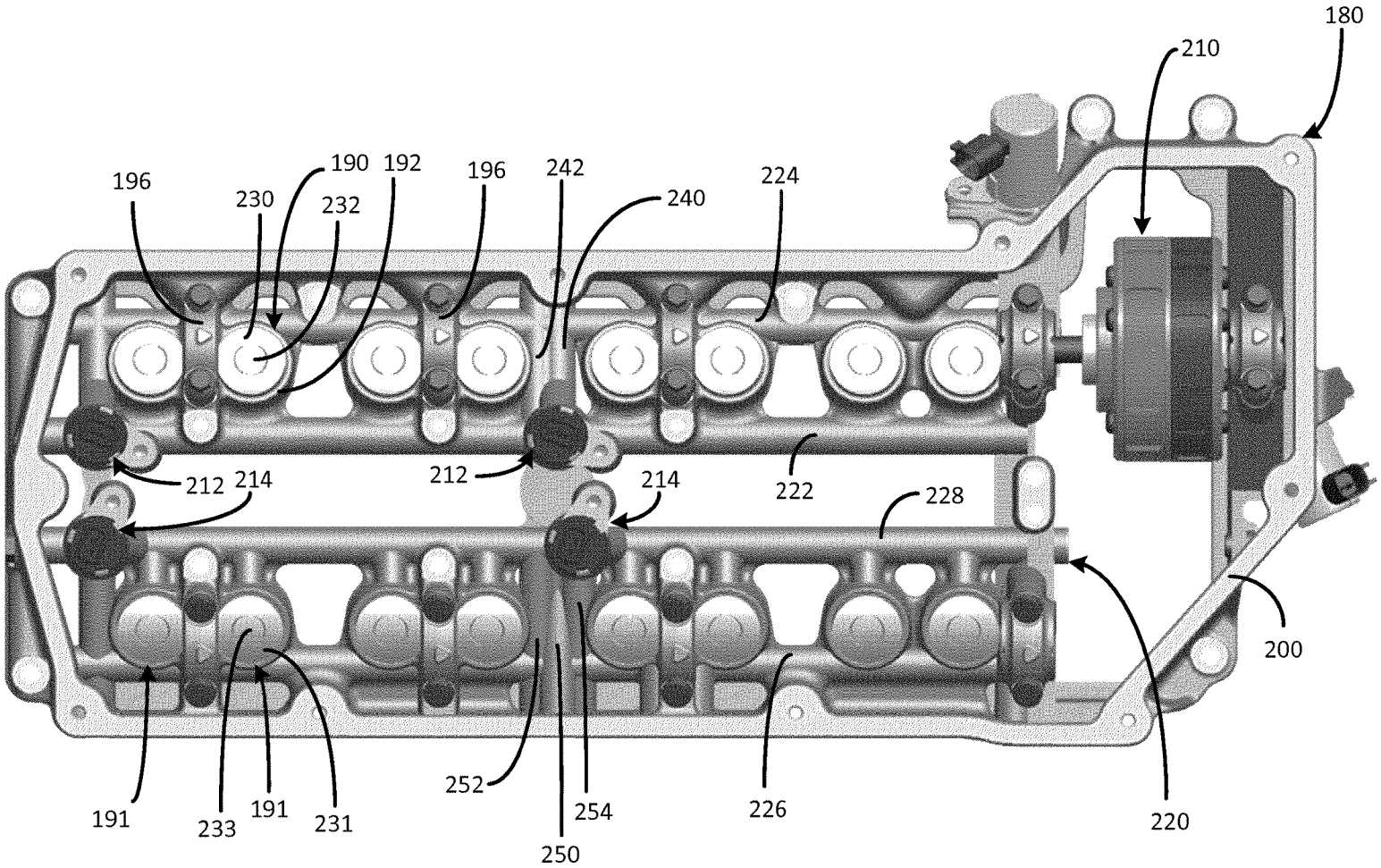
Figure 7:
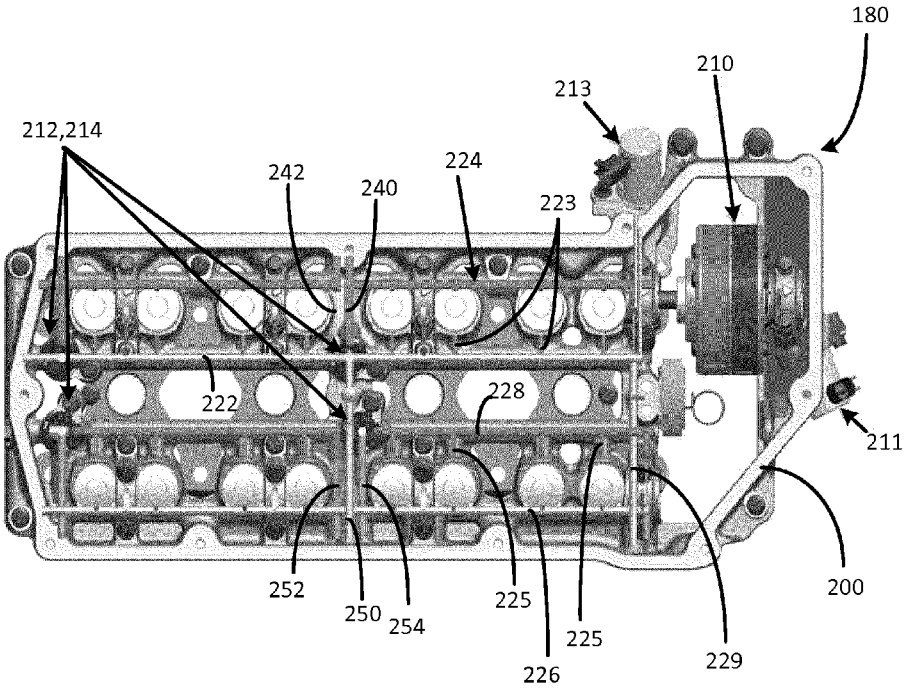
Figure 8:
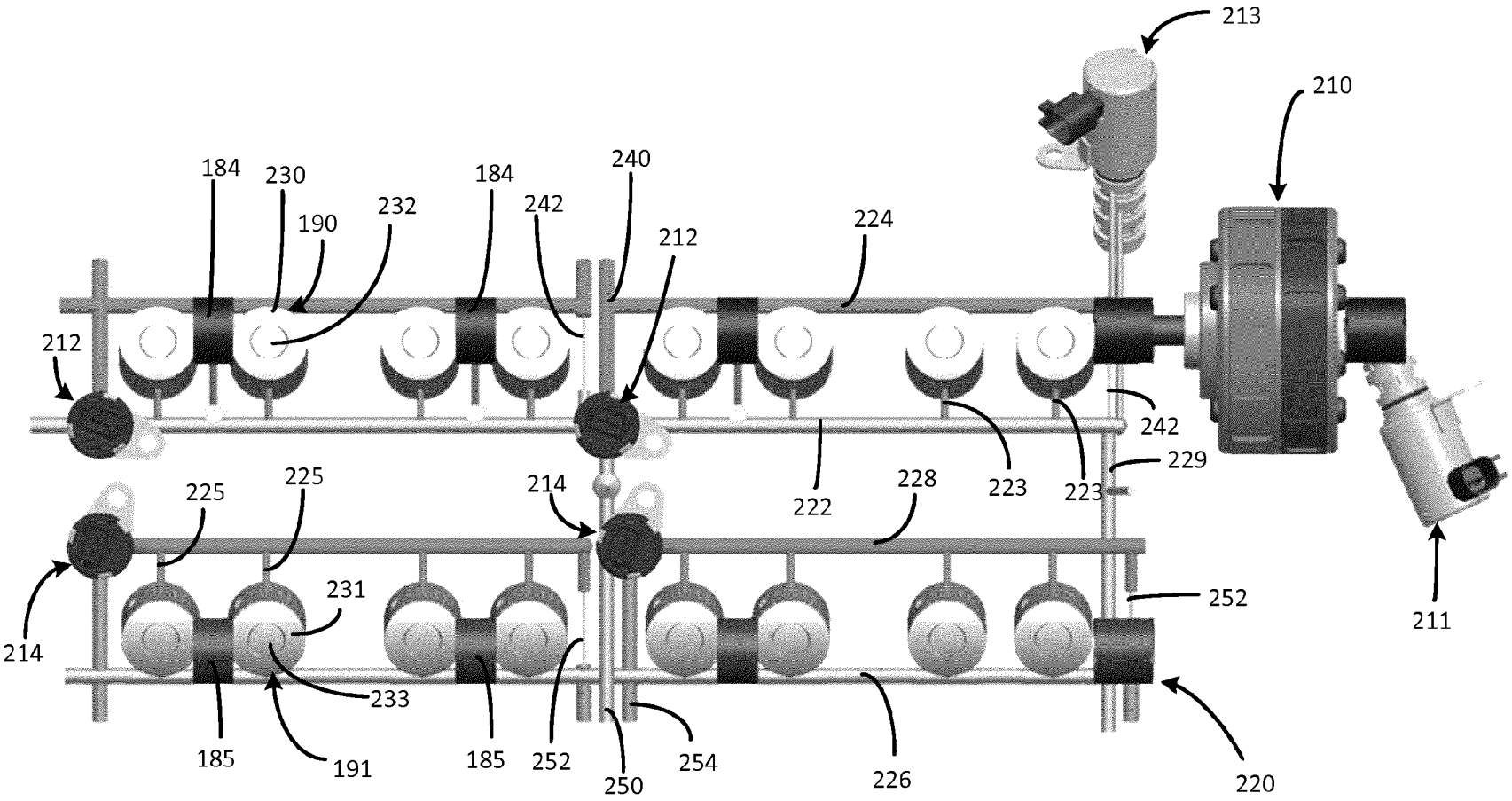

Referring to FIGS. 5-8, a top view of the valve train support portion 180 is shown with respective components omitted for clarity in describing the features of the present disclosure. As shown in FIG. 5, the sidewall 200 laterally contains a valve train support and operation system 202 and valve train lubrication system 220. The system 202 includes a dual phaser 210 fixedly secured relative to and within the sidewall 200. The dual phaser 210 is operatively coupled to an intake cam shaft or journal 184 that has a plurality of cam lobe groupings 194. Each cam lobe grouping 194 is associated with a respective intake valve of the engine 110, and includes twin high lift lobes and a low lift lobe between the high lift lobes. The cam lobe groupings 194 each is associated with a respective bucket tappet 190 translationally movable within an intake bore 192 formed in the cam carrier 150 to actuate an intake valve.

Figure 9:
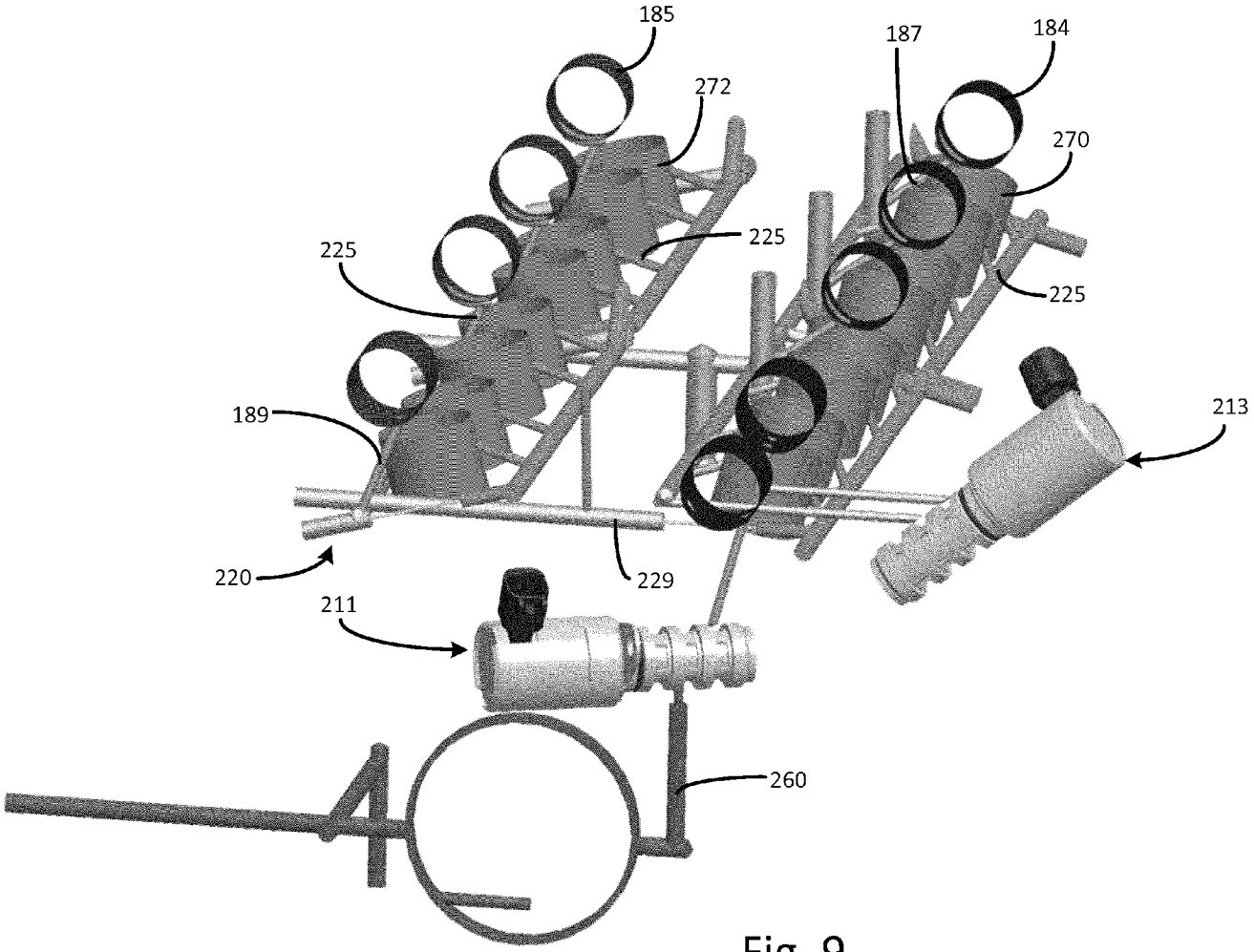
FIG. 9 is a perspective view of a lubrication source connected to lubrication components in the internal combustion engine of FIG. 3.

The intake cam shaft 184 is rotatably secured to the valve train support portion 180 via a plurality of bearings secured in place by corresponding caps 196. The intake cam shaft 184 is rotated via a belt or chain driven by the crankshaft 181 of the engine The dual phaser 210 is configured to adjust the timing or phase of the intake valves by adjusting the rotation of the cam shaft 184. The dual phaser 210 is lubrication-pressure actuated. More specifically, the dual phaser 210 is controlled by adjusting the characteristics (e.g., pressure) of lubrication (e.g., oil) received by the phaser. Adjustment of the pressure associated with each phaser of the dual phaser 210 is controlled by respective lubrication control valves 211, 213 in lubrication receiving communication with a lubrication source, such as lubrication supply line 260 (see, e.g., FIG. 9).

The valve train support and operation system 202 also includes an exhaust cam shaft or journal 185 with a plurality of lobe groupings 195. The lobe groupings 195 are similar to the lobe groupings 194 except each lobe grouping 195 is associated with a respective exhaust valve of the engine 110. Each exhaust valve is actuated by a respective bucket tappet 191 that is translationally movable within an exhaust bore 193 formed in the valve train support portion 180 to actuate an exhaust valve. The exhaust cam shaft 185 is rotatably secured to the train support portion 180 via a plurality of bearings secured in place by corresponding caps 197. The exhaust cam shaft 185 is rotated via a belt or chain driven by the camshaft 181 of the engine 110. The tension in the belt or chain can be regulated by a tensioner 204 mounted to the valve train support portion 180 within the sidewall 200.

The intake and exhaust bucket tappets 190, 191 each include an outer tappet portion 230, 231 and an inner tappet portion 232, 233. The inner tappet portions 232, 233 are translationally movable within apertures formed in the outer tappet portions 230, 231. Actuation of the inner tappet portions 232, 233 relative to the outer tappet portions 230, 231 is facilitated by modulating the pressure of a lubricant in fluid contact with the inner tappet portions. In an engine operating mode desiring low valve lift, the inner tappet portions remain in contact with the middle low lift lobes of each cam lobe grouping 194, 195, respectively. In this manner, rotation of the low lift lobes effectuates a low lift of the valves associated with the tappets 190, 191. However, for engine operating modes desiring high valve lift, the outer tappet portions 230, 231 are pressurized to remain in contact with the twin high lift lobes of each lobe grouping 194, 195, respectively. In this manner, rotation of the high lift lobes effectuates a high lift of the valves associated with the tappets 190, 191.

The valve train lubrication system 220 of the train support portion 180 includes first and second intake lubrication rifles 222, 224, and first and second exhaust lubrication rifles 226, 228. The lubrication rifles 222, 224, 226, 228 are integrated into the valve train support portion 180 and contained within the sidewall 200. The first intake and exhaust rifles 222, 226 are in lubrication receiving communication with a lubrication source (not shown) via a supply line 226. Further, each of the first intake and exhaust rifles 222, 226 includes a plurality of feed lines 223 in lubricant supplying communication with respective intake and exhaust bucket tappets 190, 191 for lubricating the tappets during use. The first intake and exhaust rifles 222, 226 also include a plurality of feed lines 225 in lubricant supplying communication with respective intake and exhaust cam journals 184, 185 for lubricating the journals during use.

The second intake and exhaust rifles 224, 228 are in lubrication receiving communication with the first intake and exhaust rifles 222, 226 via a lubrication control valve 212 positioned within the valve train support portion 180. Each of the second intake and exhaust rifles 224, 228 includes a plurality of feed lines 225 in lubricant supplying communication with a respective inner tappet portion 132, 133 of the intake and exhaust bucket tappets 190, 191. In a high lift operating mode of the engine 110, the lubrication control valves 212 are controlled to allow lubrication into the second intake and exhaust rifles 224, 228 and the associated feed lines 225 to pressurize the inner tappet portions 132, 133. Transitioning from the high lift operating mode to a low lift operating mode, the lubrication control valves 212 are closed to restrict (e.g., block) the supply of lubrication into the second intake and exhaust rifles 224, 228. The lubrication in the second intake and exhaust rifles 224, 228 is circulated or drains back into the first intake and exhaust rifles 222, 226 via respective orifices 242, 252 formed in the valve train support portion 180. In the illustrated embodiment, the valve train support portion 180 includes four lubrication control valves 212 each regulating the flow of lubrication into a respective section of the second intake and exhaust rifles 224, 228 to operate less than all of the intake or exhaust valves in the high lift mode.

The described features, structures, advantages, and/or characteristics of the subject matter of the present disclosure may be combined in any suitable manner in one or more embodiments and/or implementations. In the above description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the above description and appended claims, or may be learned by the practice of the subject matter as set forth above.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. An internal combustion engine comprising:

a base;

a cylinder block mounted onto the base;

a cylinder head mounted onto the block;

a structural overhead member removably mounted onto the cylinder head such that the cylinder head is positioned between the cylinder block and the structural overhead member, the structural overhead member defining apertures configured to receive and retain intake and exhaust cam shafts in a spaced apart relationship with the cylinder head; and at least one through-bolt positioned in a through-bolt opening, the through-bolt opening extending from the base to the structural overhead member through the cylinder block and the cylinder head to couple the base, the cylinder block, the cylinder head and the structural overhead member together.

2. The internal combustion engine of claim 1 wherein a base material of the base and a structural overhead member material of the structural overhead member have a higher-strength and higher specific weight than a cylinder block material of the cylinder block and a cylinder head material of the cylinder head.

3. The internal combustion engine of claim 2, wherein the base material and the structural overhead member material include the same material.

4. The internal combustion engine of claim 2, wherein the cylinder block material and the cylinder head material include the same material.

5. The internal combustion engine of claim 2, wherein the base material and the structural overhead member material include different materials.

6. The internal combustion engine of claim 2, wherein the cylinder block material and the cylinder head material include different materials.

7. The internal combustion engine of claim 2, wherein the cylinder block material and the cylinder head material comprise aluminum, and wherein the base material and the structural overhead member material comprise at least one of iron and steel.

8. The internal combustion engine of claim 1, wherein a portion of the through-bolt opening in one of the base and the structural overhead member includes a threaded formation configured to engage the at least one through-bolt via corresponding threads on the at least one through-bolt.

9. The internal combustion engine of claim 1, wherein a portion of the through-bolt opening in the structural overhead member includes a threaded formation configured to engage the at least one through-bolt via corresponding threads on the at least one through-bolt.

10. The internal combustion engine of claim 1, wherein the structural overhead member includes a cam carrier configured to receive and retain intake and exhaust cam shafts.

11. The internal combustion engine of claim 1, wherein the structural overhead member includes a base portion, a cam shaft support structure, and neck portion coupling the cam shaft support structure to the base portion and maintaining the base portion spaced apart from the cam shaft support structure, and wherein the through-bolt opening is positioned in the base portion.

12. The internal combustion engine of claim 1, wherein the structural overhead member includes a bolt securing portion formed as a plate, the bolt securing portion including the through-bolt opening, and wherein the structural overhead member includes a valve train support, each of the bolt securing portion and the valve train support directly coupled to the cylinder head.

13. The internal combustion engine of claim 12, wherein the valve train support comprises aluminum, and wherein the bolt securing portion comprises at least one of iron and steel.

14. The internal combustion engine of claim 12, wherein the bolt securing portion comprises a plurality of load distribution apertures interconnected by a plurality of ribs.

15. The internal combustion engine of claim 12, wherein the valve train support comprises a sidewall surrounding an outer periphery of the bolt securing portion.

16. The internal combustion engine of claim 15, wherein the sidewall further comprises a valve train lubrication system comprising one or more lubrication rifles.

17. A cam carrier of an internal combustion engine, the cam carrier being mounted onto a head of the internal combustion engine, comprising:

a cam shaft support portion supporting a cam shaft;

a base portion configured to receive a through-bolt; and a neck portion positioned between and coupling the cam shaft support portion and the base portion, wherein a gap is defined below the cam shaft between the cam shaft support portion and the base portion, wherein the cam shaft support portion, the base portion, and the neck portion are positioned on a same side of the head of the internal combustion engine.

18. The cam carrier of claim 17 wherein the base portion includes a threaded formation configured to engage at least one through-bolt via corresponding threads on the at least one through-bolt.

19. The cam carrier of claim 17, wherein the base portion comprises a plurality of load distribution apertures interconnected by a plurality of ribs.

20. The cam carrier of claim 17, wherein the cam shaft support portion comprises a sidewall surrounding an outer periphery of the base portion.

21. A cam carrier of an internal combustion engine, the cam carrier being mounted onto a cylinder head of the internal combustion engine, comprising:

a valve train support portion made from a first material, the valve train support portion being mounted directly to the cylinder head; and a bolt securing portion made from a second material, the bolt securing portion being configured to receive a through-bolt and mounted directly to the cylinder head independently of the valve train support portion, wherein the valve train support surrounds the bolt securing portion, and wherein the bolt securing portion is coupled to the valve train support portion independently of the cylinder head.

22. The cam carrier of claim 21 wherein the first material comprises aluminum, and wherein the second material comprises at least one of steel and aluminum.

23. The cam carrier of claim 21 wherein the bolt securing portion comprises a plurality of load distribution apertures interconnected by a plurality of ribs.

24. The cam carrier of claim 21 wherein the valve train support comprises a sidewall surrounding an outer periphery of the bolt securing portion.

25. The cam carrier of claim 21 wherein the sidewall further comprises a valve train lubrication system comprising one or more lubrication rifles.

26. A cam carrier of an internal combustion engine, comprising:

a sidewall enclosing a space;

a valve train support system positioned within the space, the valve train support system comprising a phaser, an intake cam shaft, an exhaust cam shaft, a plurality of intake bucket tappets, and a plurality of exhaust bucket tappets, each of the plurality of intake bucket tappets comprising an inner portion movable relative to an outer portion; and a valve train lubrication system positioned within the space, the valve train lubrication system comprising:

first intake lubrication rifles, first exhaust lubrication rifles, second intake lubrication rifles, and second exhaust lubrication rifles, a plurality of feed lines fluidly coupling the first intake lubrication rifles and the intake cam shaft, a plurality of feed lines fluidly coupling the first exhaust lubrication rifles and the exhaust cam shaft, a plurality of feed lines fluidly coupling the first intake lubrication rifles and the plurality of intake bucket tappets, a plurality of feed lines fluidly coupling the first exhaust lubrication rifles and the plurality of exhaust bucket tappets, a plurality of lubrication control valves controlling the flow of lubrication between the first intake and exhaust lubrication rifles and the second intake and exhaust lubrication rifles, a plurality of feed lines fluidly coupling the second intake lubrication rifles and the plurality of intake bucket tappets, and a plurality of feed lines fluidly coupling the second exhaust lubrication rifles and the plurality of exhaust bucket tappets.

* * * * *